US005670937A

United States Patent [19]

Right et al.

[11] Patent Number: 5,670,937

[45] Date of Patent: Sep. 23, 1997

[54] LINE MONITOR FOR TWO WIRE DATA TRANSMISSION

[75] Inventors: Robert W. Right, Huntington, Conn.; Hilario S. Costa, Sarasota, Fla.

[73] Assignee: General Signal Corporation, Stamford, Conn.

[21] Appl. No.: 441,754

[22] Filed: May 16, 1995

[51] Int. Cl.[6] ..... G08B 29/00

[52] U.S. Cl. ..... 340/506; 340/511; 340/537; 340/660; 340/825.5; 364/138; 364/188

[58] Field of Search ..... 340/511, 537, 340/657, 660, 661, 662, 825.5, 512, 505, 506, 825.06; 364/138–141, 188

[56] References Cited

U.S. PATENT DOCUMENTS

| | | | |
|---|---|---|---|
| 4,229,734 | 10/1980 | Schultz | 340/512 |
| 4,901,316 | 2/1990 | Igarashi et al. | 371/37.1 |
| 4,954,809 | 9/1990 | Right et al. | 340/516 |
| 4,962,368 | 10/1990 | Dobrzanski et al. | 340/514 |
| 5,017,905 | 5/1991 | Yuchi | 340/506 |
| 5,117,219 | 5/1992 | Tice et al. | 340/518 |
| 5,267,180 | 11/1993 | Okayama | 364/571.03 |
| 5,298,223 | 3/1994 | Berger et al. | 422/54 |
| 5,347,515 | 9/1994 | Marino | 370/85.2 |
| 5,351,034 | 9/1994 | Berger et al. | 340/577 |
| 5,398,025 | 3/1995 | Herman | 340/660 |

FOREIGN PATENT DOCUMENTS

| | | |
|---|---|---|
| 485878 A2 | 5/1992 | European Pat. Off. . |
| 3128777 A1 | 2/1983 | Germany . |
| 3128788 A1 | 2/1983 | Germany . |
| 3128796 A1 | 2/1983 | Germany . |
| 3128811 A1 | 2/1983 | Germany . |
| 3415819 A1 | 10/1985 | Germany . |
| 4027656 A1 | 3/1992 | Germany . |

*Primary Examiner*—Jeffery Hofsass
*Assistant Examiner*—Daryl C. Pope
*Attorney, Agent, or Firm*—Ohlandt, Greeley, Ruggiero & Perle

[57] ABSTRACT

A line monitor uses two wire data transmission in a fire alarm and detection system. A line voltage monitoring mechanism is within each wiring/contact monitoring circuit such that the exact value at any time of varying source voltage is known. The monitoring current resultant from the monitoring arrangement is strictly a function of impedance and not a function of source voltage because a line-monitoring scaling factor is incorporated into the final calculation. The monitoring scheme also results in the alarm and trouble voltage thresholds being suitably altered to take account of changed line voltage conditions.

5 Claims, 11 Drawing Sheets

LINE MONITOR FOR TWO WIRE DATA TRANSMISSION

The present invention relates to a line monitor for two wire data transmission in a fire alarm and detection system. The invention of this application is related to inventions described in four other applications with reference to the same fire alarm and detection system: docket 100.0600 "Field Programmable Module Personalities", docket 100.0601 "Ground Fault Detection With Location Identification", docket 100.0603 "Stand Alone Mode For Alarm-Type Module", and docket 100.0604 "Load Shed Scheme For Two Wire Data Transmission".

BACKGROUND AND OBJECTS OF THE INVENTION

The present invention is in the field of fire alarm and detection. Early examples of prior systems of this general type may be appreciated by reference to following U.S. Pat. Nos.: 4,568,919, 4,752,69,8, 4,850,018, 4,954,809, 4,962,368.

Most of the above cited U.S. patents describe systems that are approximately six to ten years old, and in most of these systems the loop controller, or the like, initiates the determination of the states of the units at the various zones or stations in the system by the use of a repetitive polling scheme for polling the detector units or stations from the loop controller, whereby addresses are sent successively on the loop or lines to determine which, if any, units are in an alarm state. Provision is also made in most of these systems to detect trouble conditions in the system.

Other fire detector and alarm systems have been developed in the recent past, that is, in the past five years or so, that provide a variety of features, including the feature of an intelligent transponder, combined with an integral processor such that communication to the loop controller of the fact that a particular transponder is in alarm is initiated by the transponder. This is sometimes called polling by exception. This results in lower communications speed while substantially improving control panel response time. Such a feature makes the system less sensitive to line noise and to loop wiring properties; twisted or shielded wire is not required.

Whatever the advantages and benefits of prior art systems, they fundamentally lack an efficient means or arrangement for providing appropriate line monitoring. The purpose of such line monitoring is to obtain information on the two wire data loop in order to detect wire gage/distance violations by the end user. In other words, on occasion the user does not properly follow wiring instructions and, because of the improper wiring, there cannot be monitoring by conventional means.

Accordingly, it is the primary object of the present invention to provide an extremely accurate means to measure slave-circuit and impedance changes as a way of closely monitoring any wire gage/distance violations. Otherwise, such wire violations would cause unpredictable and unreliable system operation.

It should be especially noted that line monitoring, in general, has been known. However, the particular line monitoring in accordance with the present invention allows sampling of the data line, the result of which reflects the level of voltage on the data line. Such level of voltage is used as a correction factor for a measurement taken on the "slave-circuit" that monitors for impedance changes. The combination of the two measurements thus provides a more accurate method of impedance monitoring which exposes and corrects for the afore-noted wiring violations.

SUMMARY OF THE INVENTION

Before launching into the summary of the invention, it is well to consider certain definitions:

a module when referred to hereinafter is an electronic circuit that is interconnected over the same wire pair as, for example, smoke detectors. Thus, in the system which forms the context of the present invention modules have been incorporated in each of the transponder units located at various zones or stations of the system, and these modules are connected over the same wire pair as the smoke detectors or other sensing devices at the given unit or station. Smoke detectors monitor particles of combustion while the modules themselves monitor external contact closure activity in connection with the outbreak of fire or the like, the closure activity resulting from the response of smoke detectors, and also such as the following: heat detectors, fire alarm pull stations, door closures, fan shutdown, etc.

In addition to the monitoring of such contact closure, it is also important to monitor the integrity of the wiring that is connected to the contact being monitored. This is normally accomplished with the use of an end-of-line resistor and a circuit that allows a small amount of current flow through the external wiring and the resistor. By monitoring this current, it is easy to detect an open wiring or closed contact condition. While this general approach is nothing new, what is novel lies in the accuracy with which this can now be accomplished.

Typically, control panels operate from regulated power sources, but they must also operate from battery power during .power failure or brown out conditions. This causes the voltage sources used to power the line/contact monitoring circuits to vary, depending on battery voltage. If a monitoring circuit was required to monitor not only on open wiring or contact closure condition, but also a change in impedance across the wiring pair, the range of impedance change would be limited to the variability of the changing line voltage as just described.

A primary feature, therefore, of the present invention resides in a line voltage monitoring mechanism within each wiring/contact monitoring circuit such that the exact value at any time of varying source voltage is known. Therefore, the monitoring current resultant from the monitoring arrangement is strictly a function of impedance and not a function of source voltage. This is because a line-monitor scaling factor is incorporated into the final calculation.

An important result of the line monitoring scheme of the present invention is that the alarm and trouble voltage thresholds are suitably altered to take account of changed line voltage conditions.

To accomplish the foregoing objects and advantages, the present invention, in brief summary, is an alarm system for detecting and warning of the presence of alarm and trouble conditions in transponder units located in a plurality of zones, comprising a loop controller having a plurality of signal/power supply lines including a wiring pair, connected to the respective units; a module, including a microcontroller, connected in each of said zones to said plurality of lines, said modules being capable of initiating communication of their conditions to said loop controller; and means, including a line extending internally of said module for monitoring the voltage such that the variable state of the source voltage is accurately known, including means for obtaining a resultant monitoring current strictly as a function of the impedance across said wiring pair, and not as a function of source voltage.

The system further includes means for incorporating a line-monitor scaling factor into the calculation of voltage or impedance, whereby alarm and trouble thresholds are altered by the line-monitor scaling factor.

In extension, the system of the present invention includes a plurality of device containing circuits coupled to said module, and means, responsive to the storage of specific configuration data, for selecting respective modes of operation for said circuits.

Other and further objects, advantages and features of the present invention will be understood by reference to the following specification in conjunction with the annexed drawings, wherein like parts have been given like numbers.

DESCRIPTION OF PREFERRED EMBODIMENTS

System and Common Module Circuitry

Figure 1:
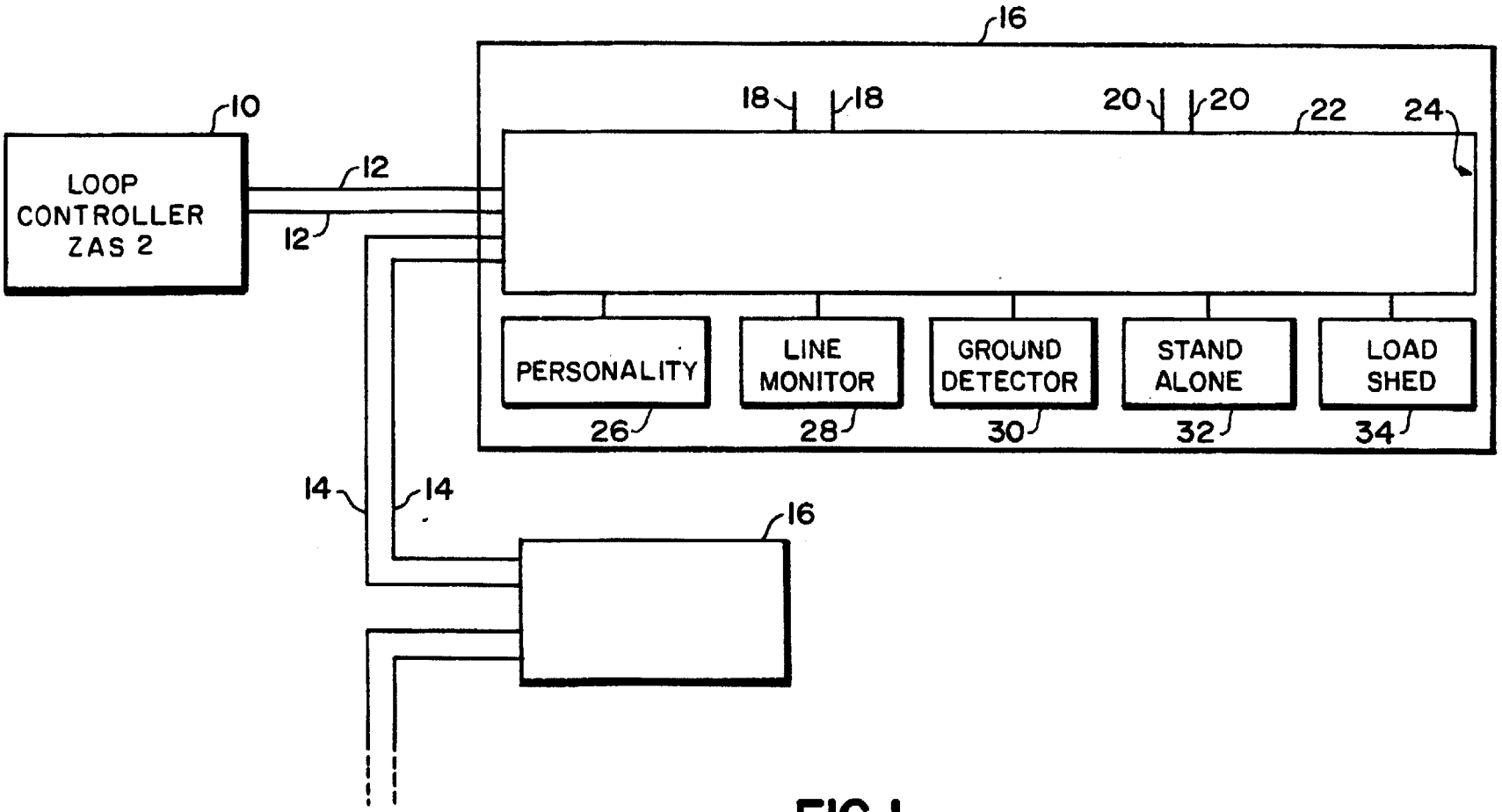
FIG. 1 is a functional block diagram which provides an simplified overview of the system in which the present invention is incorporated to constitute a unique group of transponder modules in such system.

Referring now to FIGS. 1–4 and more particularly for the moment to FIG. 1 of the drawing, there will be seen a simplified showing of the system context in which the present invention operates in order accurately to monitor and measure slave circuit impedance changes by incorporating a line voltage monitoring mechanism to be described.

In FIG. 1, the loop controller 10 is connected by multiple-wire outgoing and return cable 12 to a first transponder unit 16 which, in turn, is connected by a multiple-wire cable 14 to the next unit 16 and so on to other units.

Within the uppermost unit 16, there are seen a block designated 22 representing common components of a transponder module 24 whose inputs/outputs are represented by pairs of lines 18 and 20, which are supplied, typically with 24 v DC, and can be variously connected by the module to provide different modes of operation for the transponder 16. Also seen connected to the lower part of the common components 22 of the module 24 are the several inventive features forming parts of the module circuitry: a "personality" feature 26 which involves selective programming of a microcontroller, which forms the centerpiece of the module 24, such that various prescribed functions can be realized by the given module depending on the configuration code chosen. This personality feature is described and claimed in co-pending application, docket 100.0600 which is incorporated herein by reference.

The ground fault detector feature 30 is described and claimed in docket 100.0601. The stand alone feature 32 is described and claimed in docket 100.0603 and the load shedding feature 34 is described and claimed in docket 100.0604; the details of all of the preceding features being incorporated herein by reference to their respective patent applications already noted.

Figure 2:
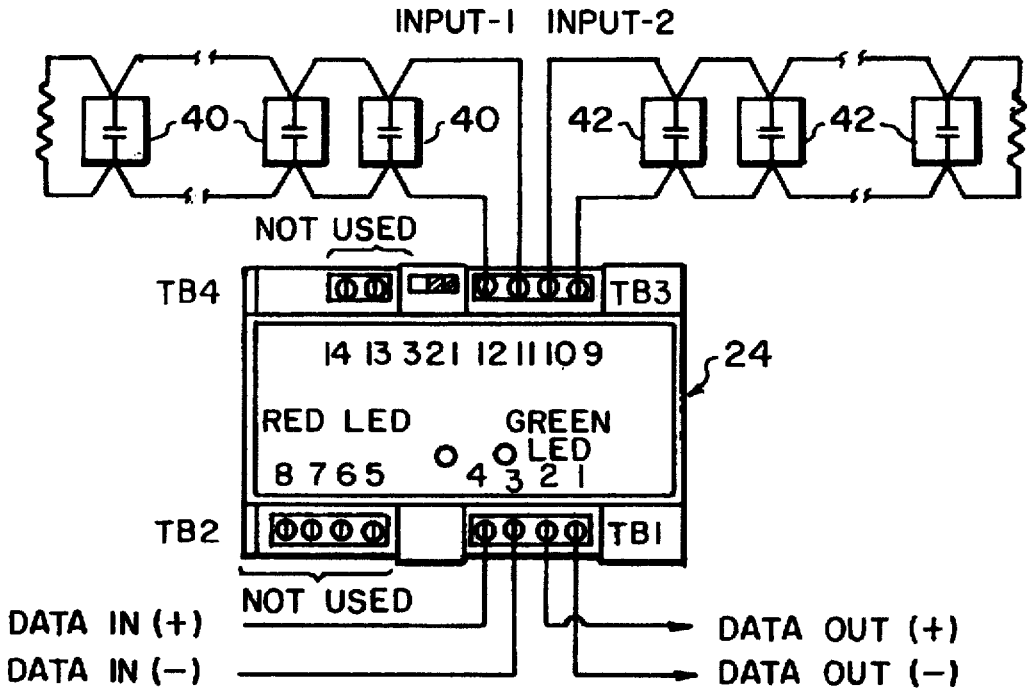
FIG. 2 is a block-schematic diagram of a class B dual input arrangement for a universal class A/B module incorporating the present invention.

Referring now to FIG. 2 of the drawing, there is depicted the module 24 which is a universal module and can be arranged, in this example, to operate class B, as a dual input module. Moreover, in this figure, connections of "data in" lines and "data out" lines are seen made to terminal blocks at the bottom of the modules, these lines corresponding, respectively, to lines 12 and 14 in FIG. 1. However, not seen in FIG. 1 are the particular class B input connections of FIG. 2, which are effectuated by the switch contacts 40, representing typical initiating devices, in input circuit 1 and, similarly, the contacts 42 in input circuit 2.

If a particular personality code, for example, personality code 1 is assigned to both of the input circuits seen in FIG. 2, this configures either one or the other or both circuits for class B normally open, involving dry contact initiating devices such as pull stations, heat detectors, etc. Consequently, when an input contact is closed an alarm signal is sent to the loop controller and the alarm condition is latched at the module 24. Further, it will be understood, particularly by reference to co-pending applications, docket 100.0600, that other personality codes assigned to the input circuits will provide different operations for water flow alarm switches, fans, dampers, doors, as well as other switches.

Figure 3:
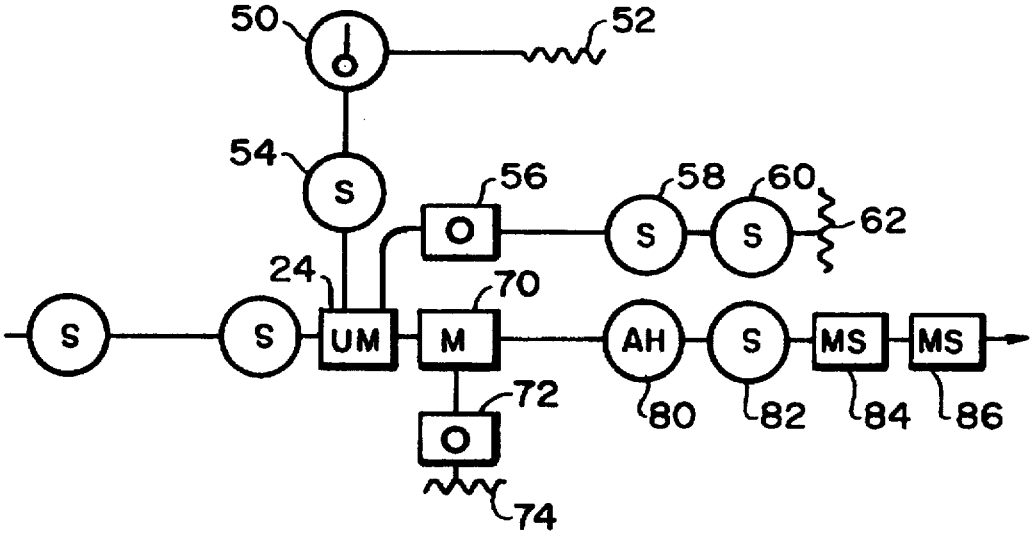
FIG. 3 is a block diagram of part of a system, and particularly illustrating a variety of devices in the form of smoke detectors and other devices connected to a universal transponder module at a given zone or station.
Figure 4A:
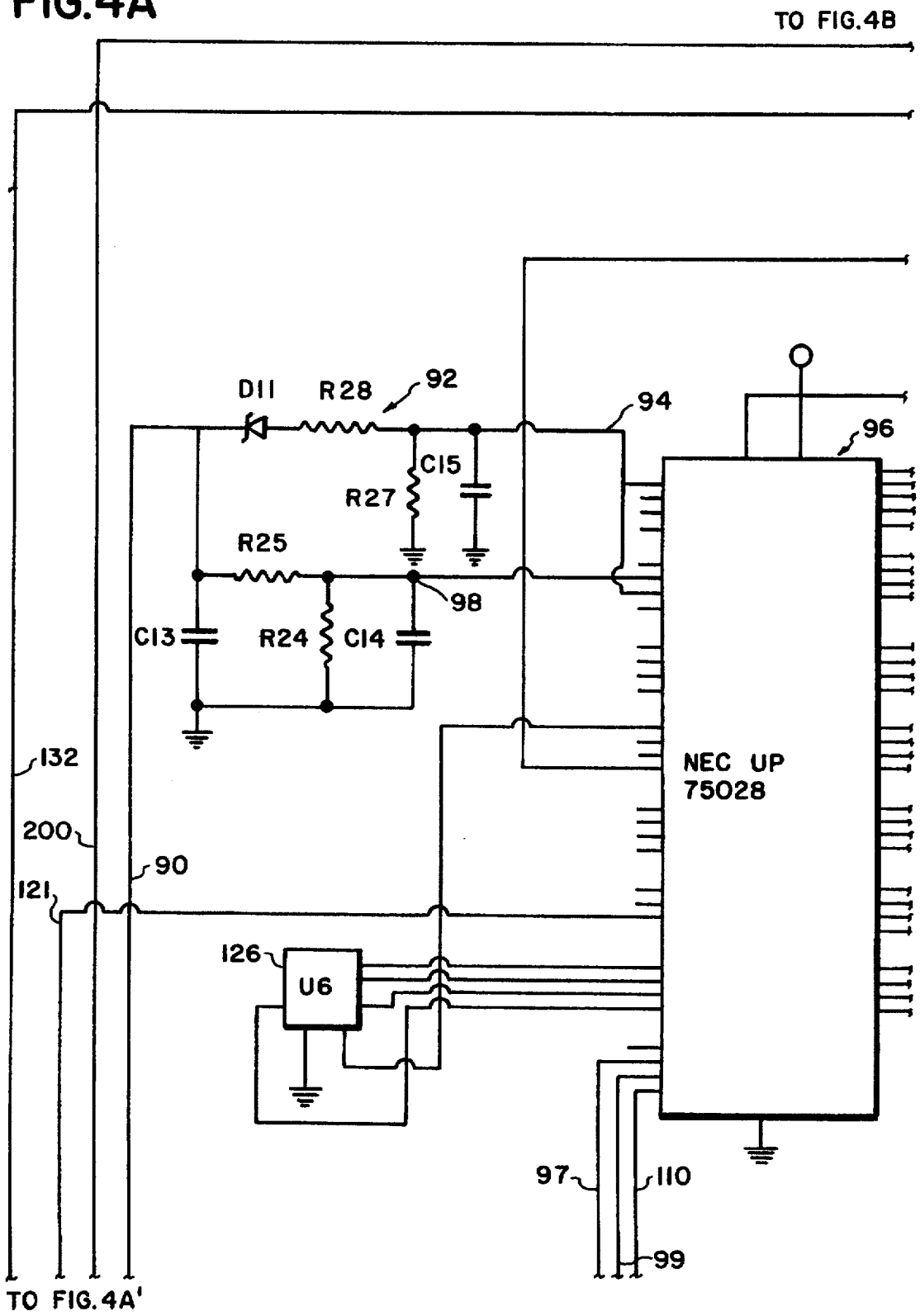
FIG. 4 is a schematic diagram of a transponder, including a module.
Figure 4B:
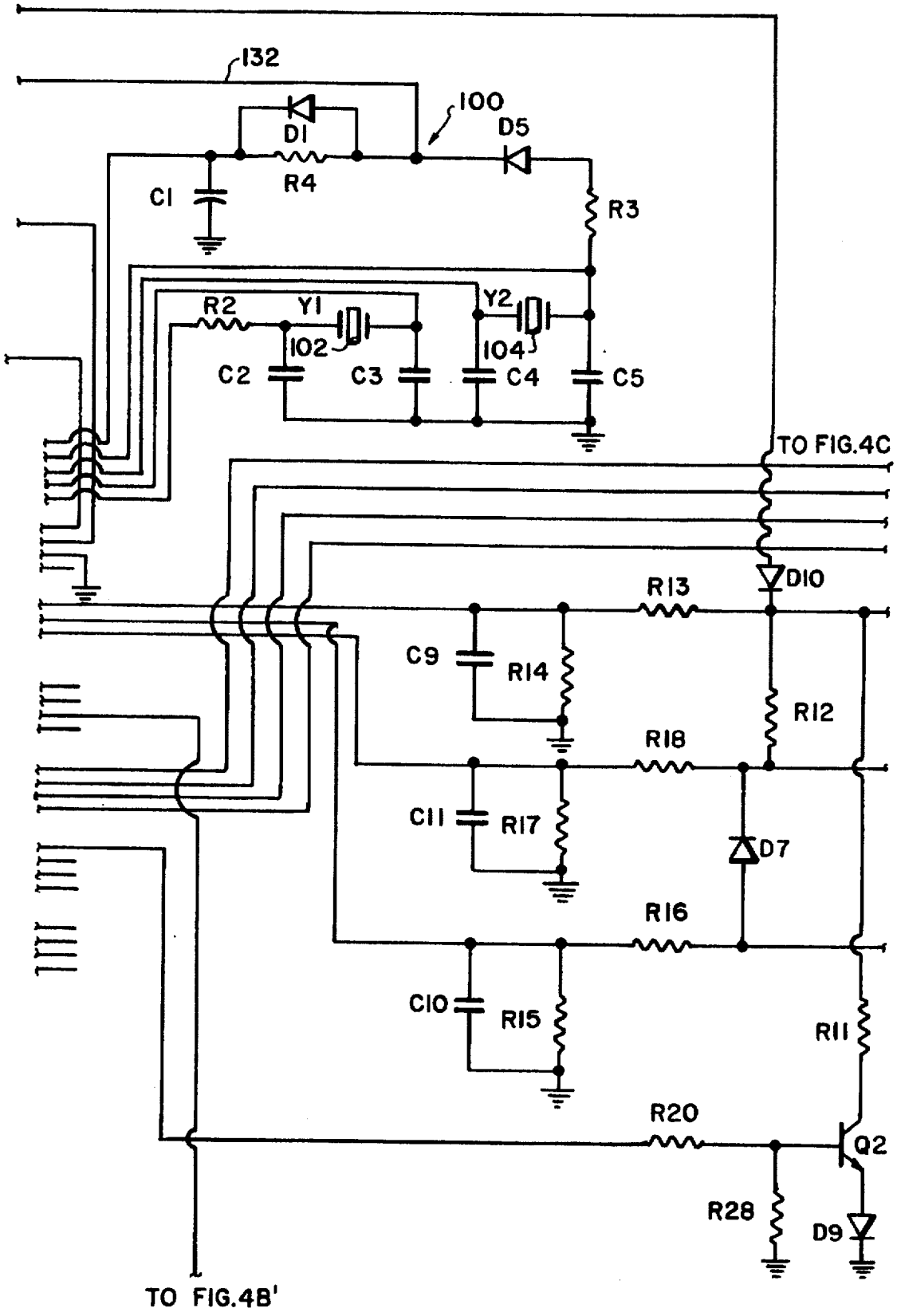
Figure 4C:
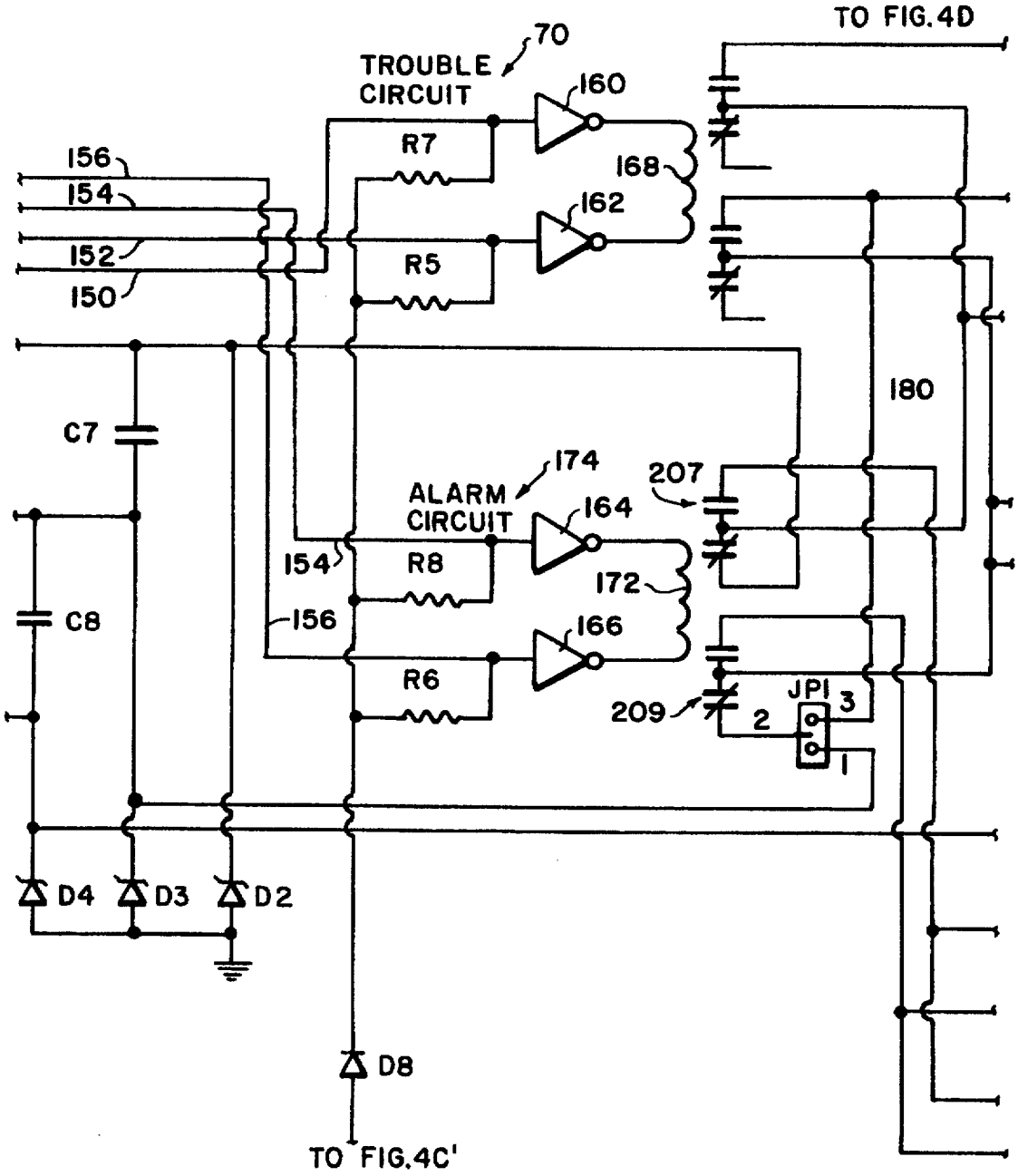
Figure 4D:
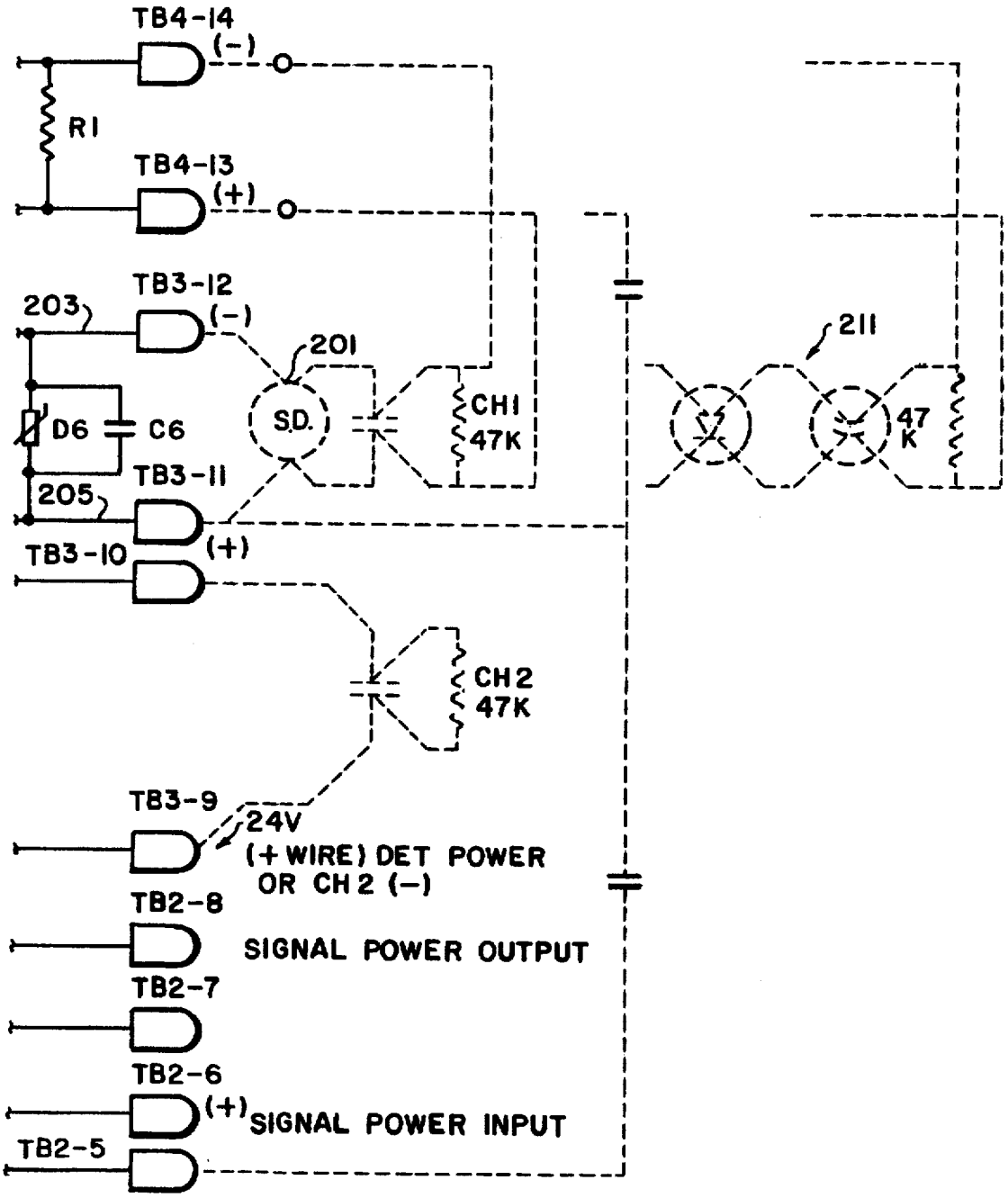
Figure 4A:
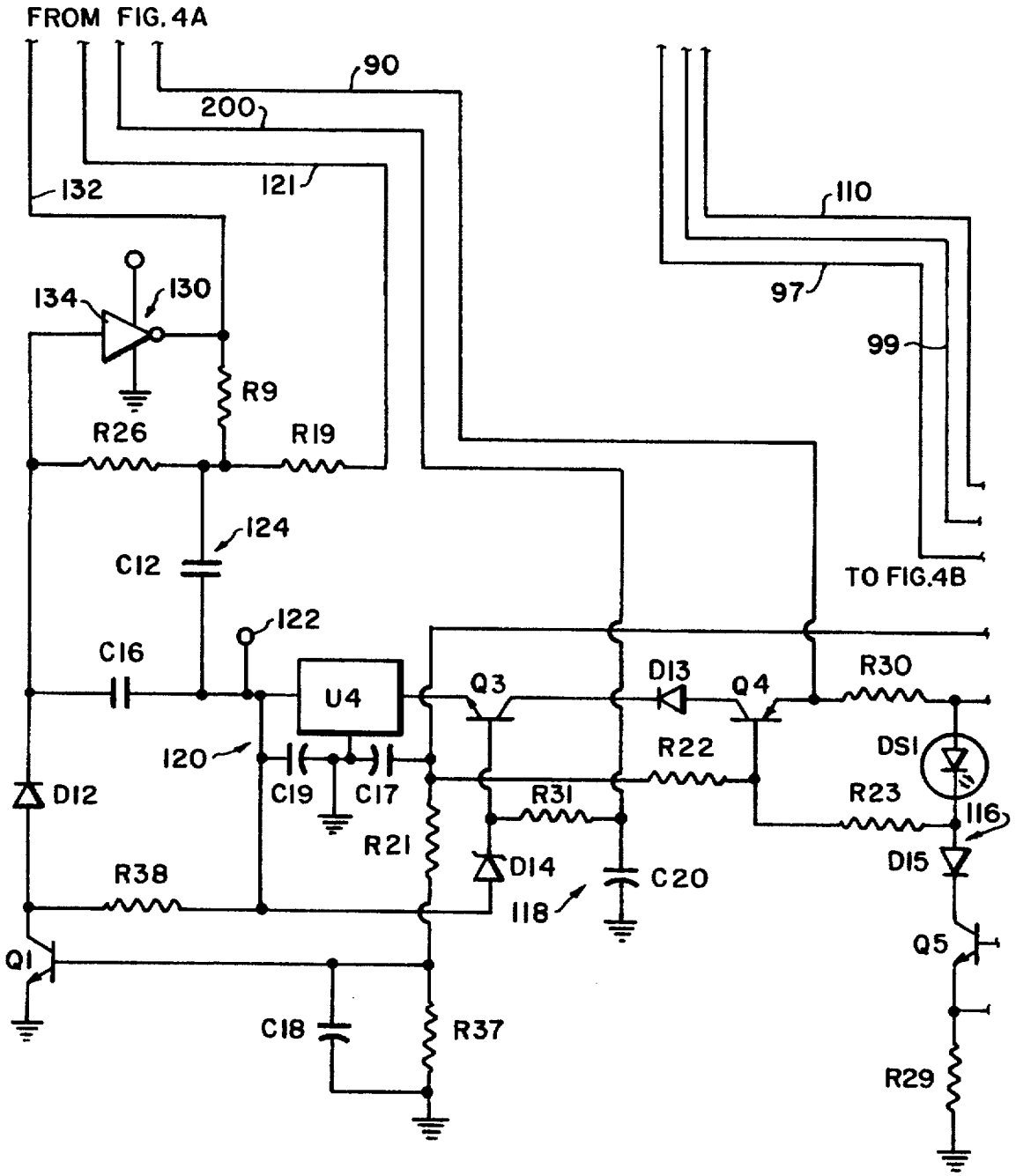
Figure 4B:
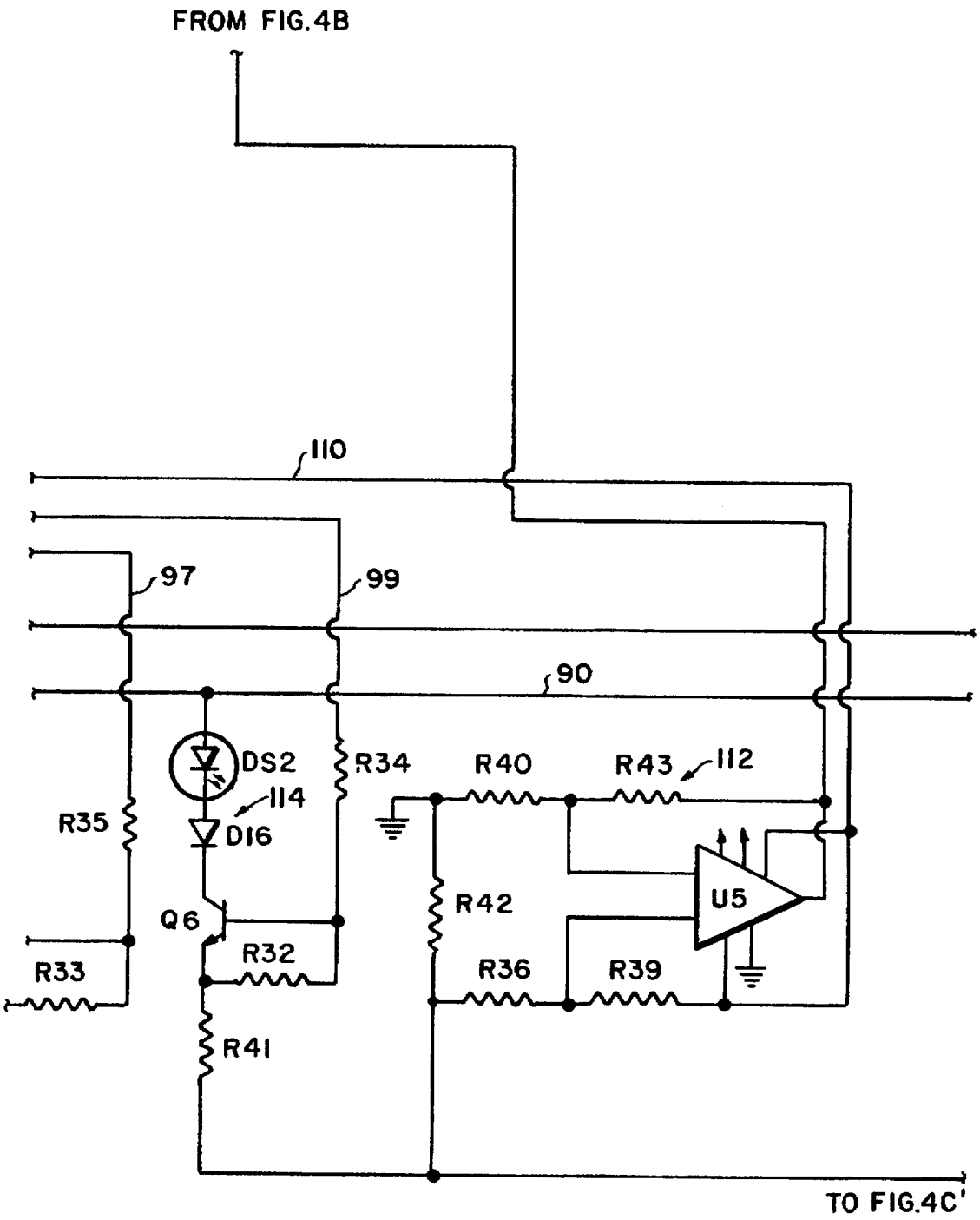
Figure 4C:
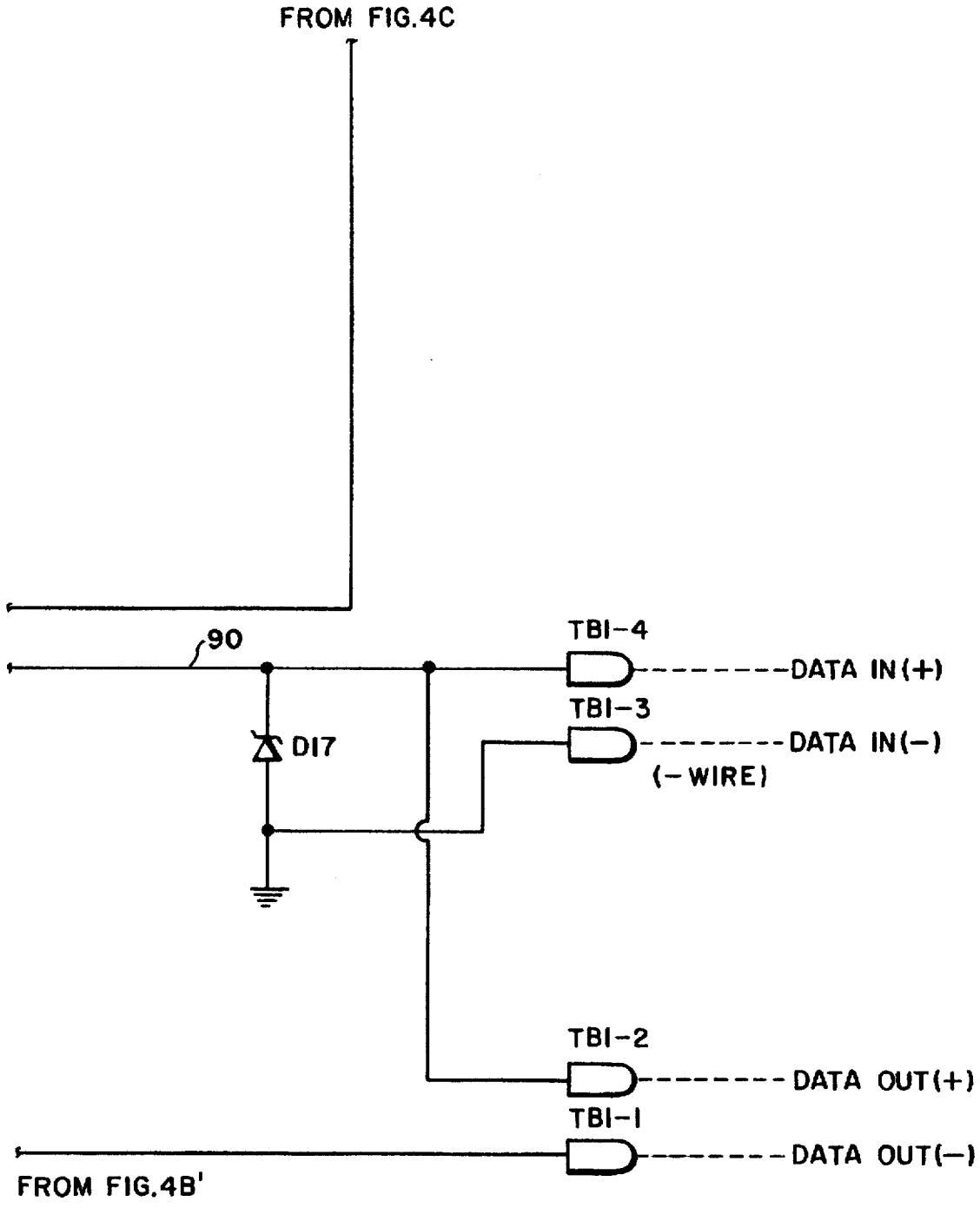
Figure 5:
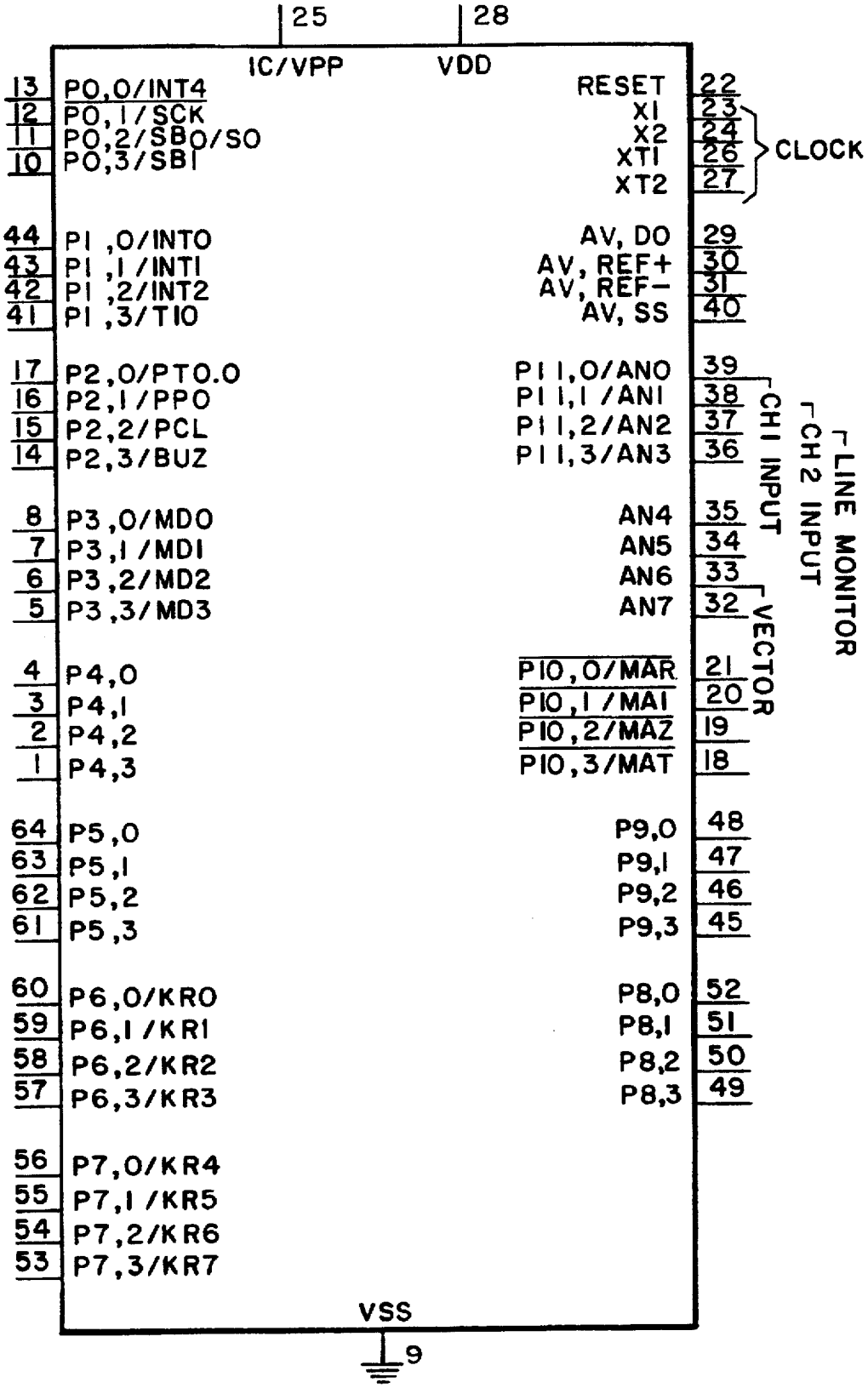
FIG. 5 is a magnified view of the microcontroller of the universal module of FIG. 4A.

FIG. 3 illustrates the system where focus is on the selected circuitry or circuitry pathways extending from the universal module 24, as previously discussed, is a part of a transponder unit 16 located at a given zone or station. The module 24 is depicted in association with a variety of devices in, for example, input circuits. Such devices can be selected as a package with such universal module 24, or the module can be incorporated into an already existing system, that is, retrofitted to an older style system to bring it up-to-date. Thus, as shown in FIG. 3, two loops extend from the upper portion of the module. One loop includes a heat detector 50, an end of line resistor 52 and a conventional smoke detector 54. In the other loop there is a manual station 56, and two conventional smoke detectors 58, 60 with an end of line resistor 62 for that other loop.

Also connected to the universal module 24, in yet another loop, is a plurality of intelligent devices, including a monitor module 70 and associated therewith a manual station 72, and an end of loop resistor 74. Also extending, in a further loop, from the afore-noted monitor module 70 is an intelligent analog heat detector 80, an intelligent analog smoke detector 82, and analog manual stations 84 and 86.

FIGS. 4A through 4D and 4A' through 4C' are combined to form a schematic diagram of the module 24 in which the line/monitor feature is embodied. To be considered first are the common aspects of such module 24. The module circuitry has at the lower right in FIG. 4C the connection from the loop controller to the "data in" lines 12 at the terminals designated TB 1-4, TB 1-3; as well as the connection to the next transponder unit at another location (see at the very bottom of the figure) by way of the "data out" lines 14 from terminals TB 1-2, TB 1-1.

It will be appreciated that data communication is accomplished over the aforesaid lines, as well as synchronous, large signal, transmission. As one example, interrupt (command) signals from the loop controller are transmitted to the module 24 over the "data in" lines (designated 12 in FIG. 1), three levels of interrupt command voltages being available; that is, zero volts, 9 volts, or 19 volts can be transmitted from loop controller 10.

The loop controller sends messages out by changing the line voltage between 0, 9, and 19 volts. The devices respond by drawing 9 ma of current during specific time periods. The basic time period of the protocol is given by:

$$T = \frac{64}{32768} = 1.953 \text{ m sec.}$$

The loop controller uses a basic time period of ½ T (0.976 ms) because it has to sample the loop voltage and current in the middle of the data bits.

Figure 6:
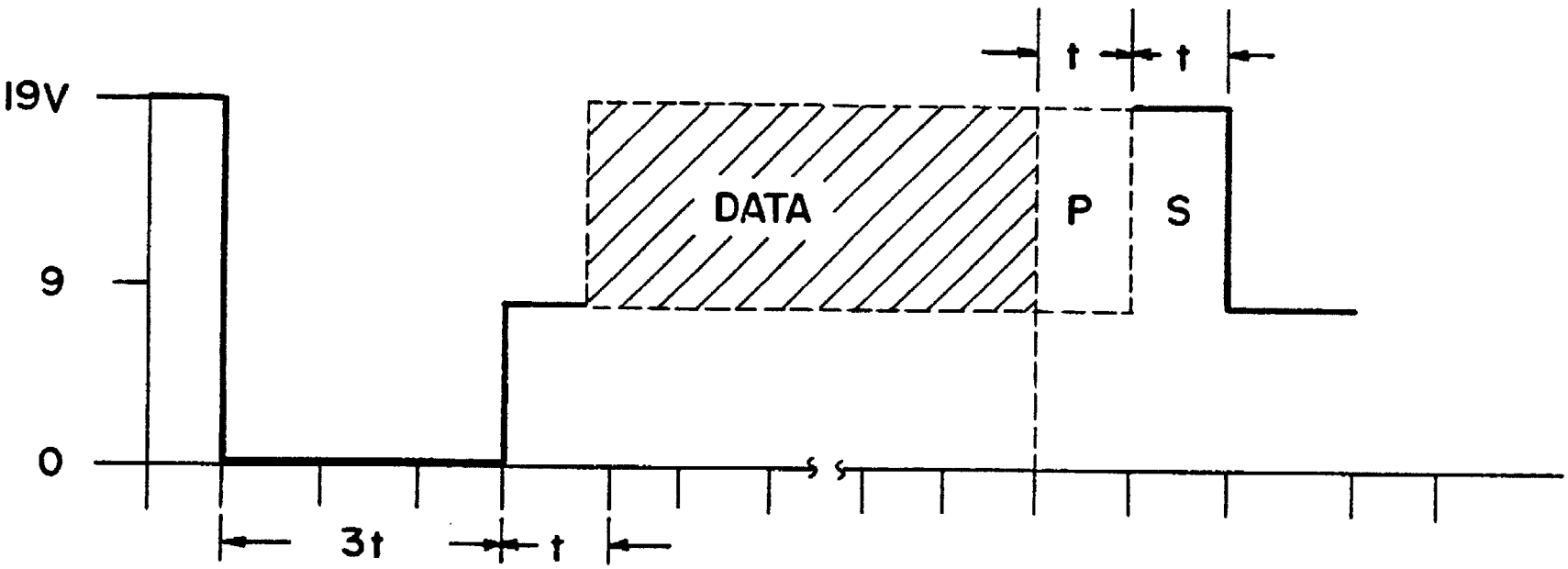
FIG. 6 is a timing diagram illustrating the application of inputs to the data lines from the loop controller.

The start-up message, or interrupt mechanism, is specific and recognized by the module as follows: (Also, see FIG. 6).

1. The line voltage (across data lines 12) is initially at 19 volts for at least 2 time periods.
2. The line is held at 0 volts for 3 time periods.
3. The line goes to 9 volts for a 1 time period—this is the wake-up or interrupt bit and modules synchronize on this edge.
4. The line alternates between 9 and 19 volts for n T periods, where n is the number of data bits in the message.
5. The parity bit (even) follows the data bits.
6. The stop bit puts the line at 19 volts for 2 T periods, then the next message may be sent.

The voltages noted above are transmitted by way of internal connection 90 to a discriminator circuit 92 at the upper left in FIG. 4, whose output is connected from the uppermost node 94 of circuit 92, via inputs 13 and 42 to input ports of microcontroller 96. The discriminator circuit 92 also includes another output, taken at node 98, to a terminal 43 of the microcontroller. This microcontroller is selected to have an NEC microprocessor therein, as well as an EEPROM 126 manufactured by NEC.

As will be appreciated, the discriminator circuit insures that when 19 volts is received from the loop controller, such value is sufficient to exceed the upper threshold set by the circuit and hence inputs 13 and 42 are active, whereas when only 9 v appear, only input 42 is active.

It should be noted that the centerpiece or control device for the module 24 is the microcontroller 96. A number of input/output ports (PO.O, etc.) to which connecting terminals are provided, are shown on each side of the microcontroller, as well as connections made to the top and bottom thereof. It will be noted that a ground connection is made at the bottom of the microcontroller (Vss) and a bias connection (3.3 volts) at the top terminals 25 and 28, as well as a connection from terminal 25 to terminal 29 on the right side of the microcontroller.

A group of terminals 22–27 are provided for reset and for timing control of the microcontroller, the timing control connection being made to a timing circuit 100, provided with two clocks 102 and 104.

Another group of terminals are used for reference and average bias manual connections, such being designated terminals 30, 31 and 40, the 3.3 volt bias, terminal 30 to an input/output port at terminal 5; and terminals 31 and 40 to ground.

Groups of analog/digital ports are connected to the terminals designated 33, 37–39 of the microcontroller, the first being a vector input from circuit 112; the last three—being monitoring terminals, as will be explained hereafter.

A further group of terminals 18–21 are connected to input/output ports of microcontroller 96, which are, in turn, connected to relay cards for purposes to be explained. Another terminal on the right of the microcontroller is terminal 48, connected to "load shed" line 101 for purposes to be explained in connection with a load shed feature in accordance with a related invention.

Other groups of terminals, connected with output ports, appear on the left of the microcontroller. The group 53–55 is shown connected to circuitry at the lower portion of FIG. 4 and which will be explained. These output ports provide communication back to the main or control panel, terminal 53 being connected by the connecting means 110 to the output of circuit 112 at the bottom of the figure and, hence, terminal 53 connects to an input port of the microcontroller; whereas 54 and 55 connect to the respective circuits 114 and 116 which are LED circuits, that is, circuits for illuminating LED's at appropriate times. Further portions of the circuitry involve a peak detector 118 and a bias circuit 120 which, as can be seen, has the node 122 and supplies the bias of 3.3 volts for the microcontroller 96. A watchdog circuit 124 is seen immediately above the bias circuit 120, having a connection 121 to the microcontroller at terminal 62. Another group of four input/output ports is connected by respective terminals 57 through 60 to terminals of a 64 bit register 126. It will be seen that a connection from terminal 8 of the microcontroller is made to terminal 8 of register 126 for the purpose of providing a "strobe" to the register 126 in order to read the unit's identifying number stored in such register.

A reset circuit 130 furnishes a Reset+signal by way of the connection 132 to the clock circuit 100, the amplifier 133 in such circuit being biased from the 3.3 volts supply provided at node 122.

It will be noted that output terminals 18–21 of microcontroller 96 extend, by means of respective connections 150, 152, 154, and 156, to respective operational amplifiers, 160, 162, 164, and 166. The former two, that is, 160 and 162 are connected to respective ends of coil 168 and a trouble circuit 170 (which can be operated in class A, if desired), whereas, the operational amplifiers 164 and 166 are connected to opposite ends of relay coil 172, thus defining an alarm circuit 174.

Each of the relays in the trouble and alarm circuits is a double-pole, double throw, each involving four relay contacts, two being shown open and two being shown closed in each circuit.

The smoke detector 201 is seen connected across terminals TB 3-11 and TB 3-12; thence, by connecting means 203 and 205 to the respective points between pairs of alarm relay contacts 207 and 209. Alternative devices, such as bell or speaker 211 are similarly connected when called for—being accomplished—by selecting appropriate states for the relay contacts 203, 205, 207 & 209.

It will be understood that the specific type of device, i.e., bell, telephone, heat detector, manual pull station, etc., that is selectively connected to the module is dependent on the assigned personality, or set of configuration bits, that is sent to the modules memory at the time of installation (and which set can be suitably changed at a later time, as already explained). For example, if the personality that is sent to the module is "2-wire smoke detector", then non-intelligent conventional-type 2-wire smoke detectors would be connected to terminals 11 and 12. Conversely, if the personality desired was to operate bells during alarm condition, the personality "Class B or Class A Signal Output" would be assigned and bells would be connected to terminals 11 and 12, and no 2-wire smoke detectors would be allowed on this module. Likewise, other selected personalities for the module would dictate other modes of operation for that portion of the circuitry in which the devices are selectively connected.

Line Monitor Feature

Referring again to FIG. 4A, the line monitor scheme of the present invention will be fully appreciated by first referring to the two analog channels connected to the microprocessor 96 (on its right side); that is, to the channel 1 input connected to terminal 39 of the microprocessor and channel 2 input connected to terminal 38 thereof.

It will be understood that the above-noted channel 1 and channel 2 inputs are totally unrelated to the afore-noted interrupt or command signals that are sent to the microprocessor from the loop controller, as already described. Instead, what happens is that the operating system program for the microprocessor 96 is always "running"; thus, the program set up within such microprocessor is such that it provides a continuous check on the state or condition of channel 1 and channel 2 analog inputs (whose signals are converted by the microprocessor to digital signals). In other words, the program monitors CH 1 and CH 2 for active or inactive conditions. The CH 1 and CH 2 analog inputs receive analog signals over the respective connections 182 and 184 from the terminals TB 3-12 and TB 3-9, respectively.

While the process of checking on the status or condition of the various circuits is going on, the line monitor intervenes to determine the voltage variation on the data lines extending from the loop controller (i.e., lines 12 or the like).

The connection 200 serves for line monitor purposes, and will be seen extending upwardly to the left of previously noted connection 90. This connection 200 extends the data-in line from terminal TB 1-4, thence, by way of diode D10 and resistor R12 and to the terminal 37 of the microprocessor 96. Accordingly, the line monitor, acts to monitor on a continuous basis the voltage level on the data-in lines 12. If the data lines have developed a higher than desired voltage, there will be a trouble condition and likewise if the voltage level is too low, there will be a trouble condition developed and transmitted. Thus, the two fundamental purposes of the line monitor are to insure that there is line integrity, and, additionally, to maintain the appropriate thresholds for the trouble and alarm states.

A fundamental difference then in the system of the present invention, when compared with the prior art, is that the unique line monitor scheme does not merely compare the analog value sensed or monitored on the channel 1 and channel 2 inputs with internally fixed values of trouble and alarm thresholds. Instead, in accordance with the present invention, an adjustment of the trouble and alarm thresholds takes place because of the effect produced by the line monitor feature; that is, because a factor is introduced by the line monitor arrangement such that the trouble and alarm threshold voltages are each adjusted, by operation of the microprocessor 96, to maintain a constant relationship with the line voltage.

Accordingly, a fixed ratio is established between the measurement of the varying voltage value on the data input lines by the action of the fine monitor analog input, the resultant conversion of this analog voltage value to a digital value controls the re-setting of the trouble and alarm threshold values. This happens because there is a stored, established relationship within the microprocessor based on certain default values. For example, by means of default programming, the above-noted ratio can be established such that the trouble and alarm thresholds adjust in accordance with that ratio, based on the line monitor measurement of the varying voltage value on the data lines, whereby the relationship between the thresholds and the varying data line voltage is fixed. For accomplishing this, a predetermined register in the memory 126 associated with microcontroller 96 will have two values in it, one being stored in the low byte section of such register, and one in the high byte section. The general equation for the relationship is x/16 times the line monitor value equals the alarm threshold. For example, for the first value in the low byte section, the relationship could be that 12/16ths×the value that's read at the line monitor is equal to the alarm threshold. Of course, if one wanted to change the alarm threshold, one could change that stored number, i.e., 12 in the example above, to a different number, and the alarm threshold would be changed accordingly. Likewise for the trouble threshold.

It can be seen that since the value that's in that register is multiplied by the line monitor voltage, then, as the line monitor varies, the alarm threshold varies with it. So, in effect, the same ratio can be maintained between the line and the input channel we are measuring against. We are measuring, in effect, the result of an impedance value. Any one of those 3 analog channels—channel 1, channel 2, or line monitor—simply is measuring a voltage, and that voltage has been divided down by the use of some resistors or impedance and brought down to scale through so that the microcontroller can read it, but its a reflection of the impedance changes out at the end of the line; as for example, if there is a series resistance of the data line due to the characteristics of the cable interconnecting the loop controller and module, then a voltage loss will occur in the wiring and result in a lower voltage available at the module's data input terminals. This loss of voltage in the wiring becomes more pronounced when multiple modules are used, increasing the current flow in the line, thus reducing the module's terminal voltage further. Due to the reduction of module terminal voltage, the voltage across the 'slave' circuit End-of-line Resistor is also reduced, therefore, affording a different impedance level to develop an alarm or trouble condition if fixed thresholds had been employed. Accordingly, what is being measured is an impedance change across that circuit. Terminal 11 and 12—that's the plus side of the circuit, if you follow back through the alarm relay terminal, i.e., TB 3-9 and 10 terminals through the little JP 1, which is a jumper plug or header, connecting its terminals 1 and 2 together, which goes to a point on FIG. 4D just above diode D7, which is right from the data line connection 200.

The invention having been thus described with particular reference to the preferred forms thereof, it will be obvious that various changes and modifications may be made therein without departing from the spirit and scope of the invention as defined in the appended claims.

We claim:

1. An alarm system for detecting and warning of the presence of alarm and trouble conditions in transponder units located in a plurality of zones, comprising:

a loop controller having a plurality of signal/power supply lines, including a wiring pair, connected to the respective units;

a module, including a microcontroller, connected in each of said predetermined zones to said plurality of lines, said module being capable of initiating communication of the alarm and trouble conditions of said circuits to said loop controller;

a plurality of outgoing circuits extending from said microcontroller, and means within said microcontroller for selectively operating said circuits in a variety of modes; and means, including a connection extending from said microcontroller to a portion of said selectively operated circuits .and a line, for monitoring the line voltage such that the variable state of that voltage is accurately known, including means for obtaining a resultant monitoring current, which is indicative of the presence of alarm and trouble conditions, strictly as a function of the impedance across said wiring pair, and not as a function of the source voltage.

2. An alarm system as defined in claim 1, in which said line for monitoring the line or source voltage also extends from an input terminal on said microcontroller to a node on said portion of said selectively operated circuits.

3. An alarm system as defined in claim 2, in which a pair of input connections are made to other terminals of said microcontroller for sensing whether or not alarm or trouble conditions are present in said circuits.

4. An alarm system as defined in claim 3, in which means are provided within said microcontroller for adjusting the alarm and trouble thresholds to which the microcontroller responds so that said thresholds have a fixed relationship or fixed ratio with respect to the line voltage.

5. An alarm system as defined in claim 1, further comprising a plurality of respective devices in said selectively operated circuits.

* * * * *